US009982573B2

(12) United States Patent
David et al.

(10) Patent No.: US 9,982,573 B2
(45) Date of Patent: May 29, 2018

(54) CAMSHAFT PHASER

(71) Applicant: DELPHI TECHNOLOGIES IP LIMITED, St. Michael (BB)

(72) Inventors: Pascal David, Beidweiler (LU); Pierre Kimus, Attert (BE); Sebastien Mafrica, Aubange (BE)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days. days.

(21) Appl. No.: 15/172,291

(22) Filed: Jun. 3, 2016

(65) Prior Publication Data

US 2017/0350283 A1 Dec. 7, 2017

(51) Int. Cl.
*F01L 1/34* (2006.01)
*F01L 1/344* (2006.01)

(52) U.S. Cl.
CPC ..... *F01L 1/344* (2013.01)

(58) Field of Classification Search
CPC ..... F01L 1/344
USPC ..... 123/90.17
See application file for complete search history.

(56) References Cited

U.S. PATENT DOCUMENTS 6,135,077 A * 10/2000 Moriya ..... F01L 1/344 123/90.15
2006/0260577 A1* 11/2006 Suga ..... F01L 1/022 123/90.17
2015/0167709 A1* 6/2015 Buchta ..... F16B 5/02 411/546

* cited by examiner

*Primary Examiner* — Zelalem Eshete
(74) *Attorney, Agent, or Firm* — Joshua M. Haines

(57) ABSTRACT

A camshaft phaser includes a stator having an inner wall with lobes extending radially inward and a stator flange extending radially outward, the stator flange having a plurality of apertures; a rotor coaxially disposed within the stator, the rotor having vanes interspersed with the lobes defining alternating advance chambers and retard chambers; a plurality of compression limiters extending through the apertures; a front cover which closes one end of the advance and retard chambers; a back cover which closes the other end of the advance and retard chambers; and a plurality of fasteners which extend through the apertures such that the fasteners apply a clamping load which clamps the stator between the front cover and the back cover such that the clamping load is transmitted through the compression limiters.

12 Claims, 3 Drawing Sheets

CAMSHAFT PHASER

TECHNICAL FIELD OF INVENTION

The present invention relates to a camshaft phaser which selectively varies the phase relationship between a crankshaft and a camshaft of an internal combustion engine; more particularly to such a camshaft phaser which includes a stator having a plurality of inwardly extending lobes and a rotor having a plurality of outwardly extending vanes that are interspersed with the lobes to define advance and retard chambers; and still even more particularly to such a camshaft phaser which includes compression limiters which carry a clamping force between a back cover and a front cover which close off the advance and retard chambers.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. A back cover and a front cover are used to close off respective sides of the advance chambers and the retard chambers such that fasteners are used to clamp the stator between the front cover and the back cover. Engine oil is selectively supplied to either the advance or retard chambers and vacated from the other of the advance and retard chambers by an oil control valve in order to rotate the rotor within the stator and thereby change the phase relationship between an engine camshaft and an engine crankshaft.

German patent application publication number DE 102010010205 A1 to Gautier, hereinafter referred to as Gautier, shows an example of a camshaft phaser as previously described. Gautier teaches that a toothed pulley is spaced radially outward from the stator such that the toothed pulley is integrally formed with the back cover. The stator is clamped between the back cover and the front cover by a plurality of cover bolts which extend through apertures formed in each of the lobes of the stator in order to seal the advance and retard chambers between the back cover and the front cover. However, the stator of Gautier includes five lobes spaced substantially equally around the stator. Consequently, five equally spaced cover bolts provide a clamping force to clamp the stator between the back cover and the front cover. While five equally spaced cover bolts may be sufficient to clamp the stator between the back cover and the front cover, some camshaft phasers have stators with fewer lobes or with lobes that are not equally spaced. Consequently, cover bolts that pass through apertures in the lobes may not provide an adequate clamping force to provide a proper seal between the back cover and the stator and between the front cover in all stator designs. Furthermore, some camshaft phasers have stators with lobes that are not sufficiently large to accommodate cover bolts passing therethrough.

EP patent application publication EP 2058478 A1 to Sluka et al., hereinafter referred to as Sluka et al., shows another example of a camshaft phaser as previously described. Sluka et al. teaches a stator having an inner stator wall from which three lobes extend radially inward. The stator also includes an outer stator wall formed integrally therewith which is spaced radially outward from the outer stator wall such that the outer stator wall includes pulley teeth on the outer circumference thereof. The stator also includes a front cover formed integrally therewith which closes off one side of the advance chambers and the retard chambers. A back cover is clamped to the stator using cover bolts in order to close off the other side of the advance chambers and the retard chambers. A plurality of ribs extend radially between the inner stator wall and the out stator wall such that three of the ribs are sufficiently large to accommodate apertures for receiving cover bolts which clamp the front cover to the stator. The ribs extend axially the same distance as the inner stator wall; consequently, the ribs carry a clamping force from the cover bolts. While the stator of Sluka et al. allows the placement of the cover bolts to be independent of the location of the lobes of the stator, the ribs which receive cover bolts can be difficult to form in stators that are made using powder metal process. Furthermore, the ribs add weight to the stator which goes against the desire to minimize weight in order to maximize fuel efficiency of motor vehicles.

What is needed is camshaft phaser which minimizes or eliminates one or more the shortcomings as set forth above.

SUMMARY OF THE INVENTION

A camshaft phaser is provided for use with an internal combustion engine for controllably varying the phase relationship between a crankshaft and a camshaft in the internal combustion engine. The camshaft phaser includes a stator extending along an axis and having an inner stator wall, the inner stator wall including a plurality of lobes extending radially inward therefrom and a stator flange extending radially outward therefrom, the stator flange having a plurality of stator flange apertures extending therethrough. A rotor is coaxially disposed within the stator, the rotor having a plurality of vanes interspersed with the plurality of lobes defining a plurality of alternating advance chambers and retard chambers extending axially from a back end to a front end. The camshaft phaser also includes a plurality of compression limiters, each one of the plurality of compression limiters extending through a respective one of the plurality of stator flange apertures. A front cover closes the front end of the plurality of advance chambers and the plurality of retard chambers and a back cover closes the back end of the plurality of advance chambers and the plurality of retard chambers. The camshaft phaser also includes a plurality of fasteners, each one of the plurality of fasteners extending through a respective one of the plurality of stator flange apertures such that the plurality of fasteners apply a clamping load which clamps the stator between the front cover and the back cover such that the clamping load is transmitted through the plurality of compression limiters.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
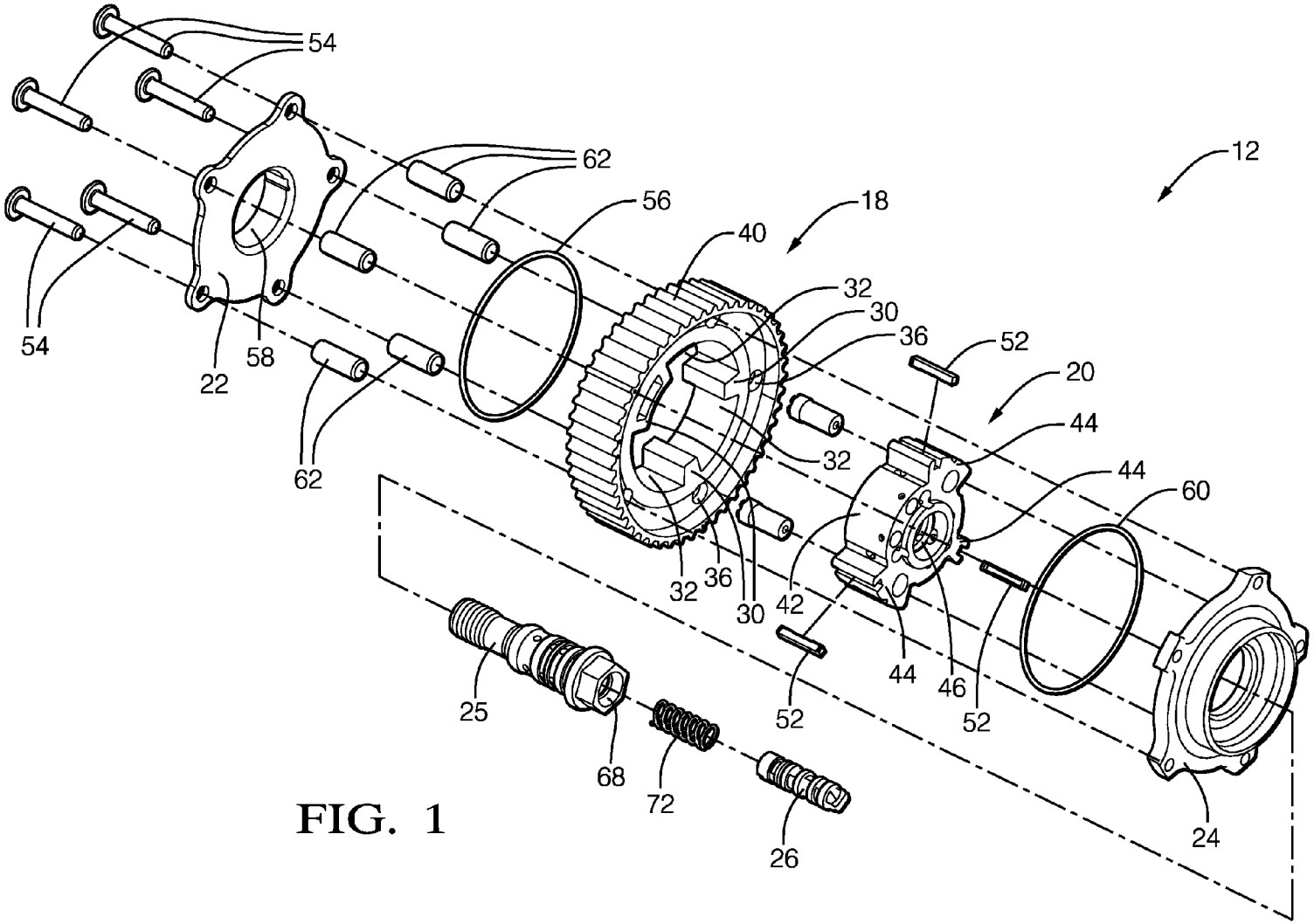
FIG. 1 is an exploded isometric view of a camshaft phaser in accordance with the present invention.
Figure 2:
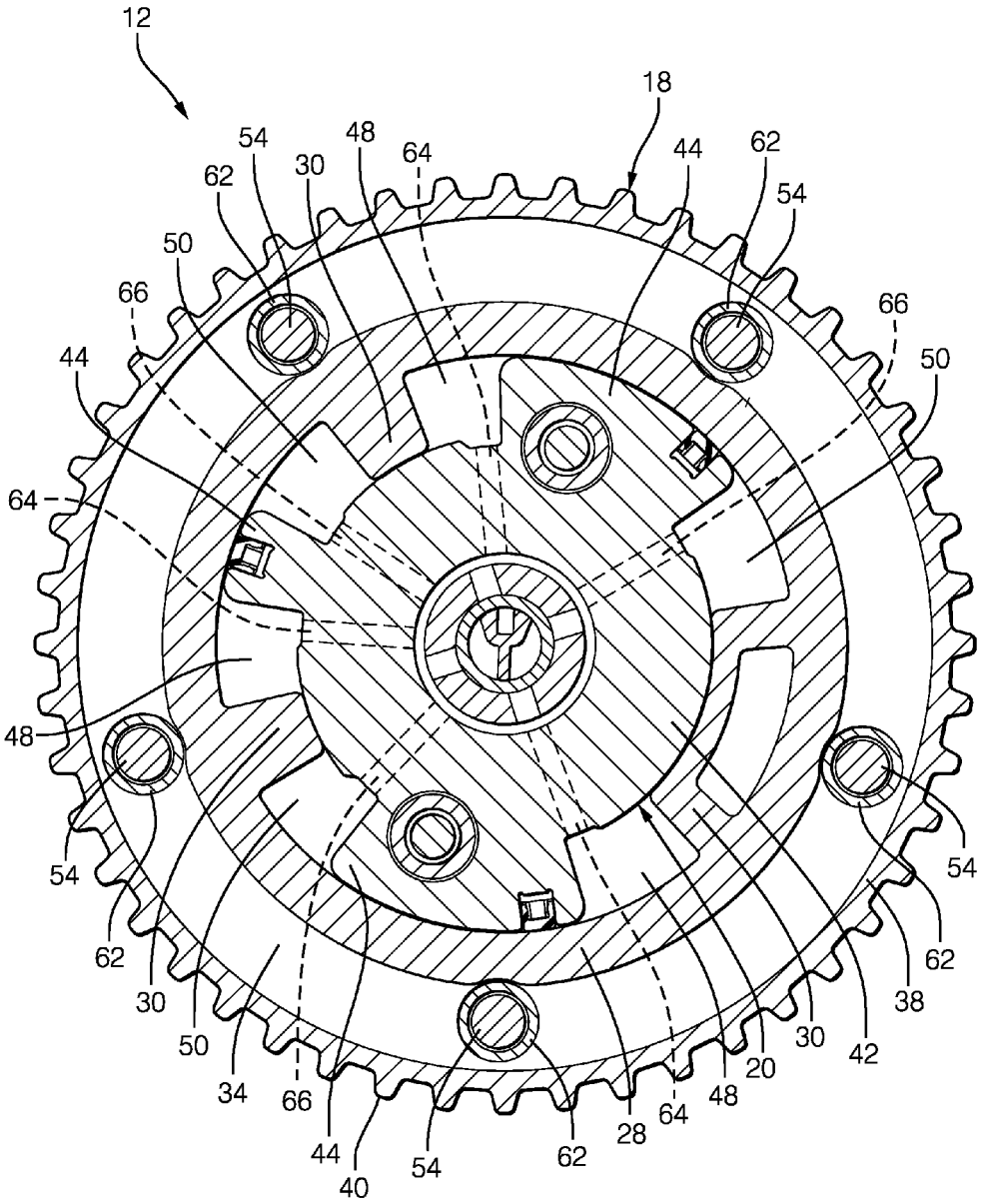
FIG. 2 is a radial cross-sectional view of the camshaft phaser of FIG. 1.
Figure 3:
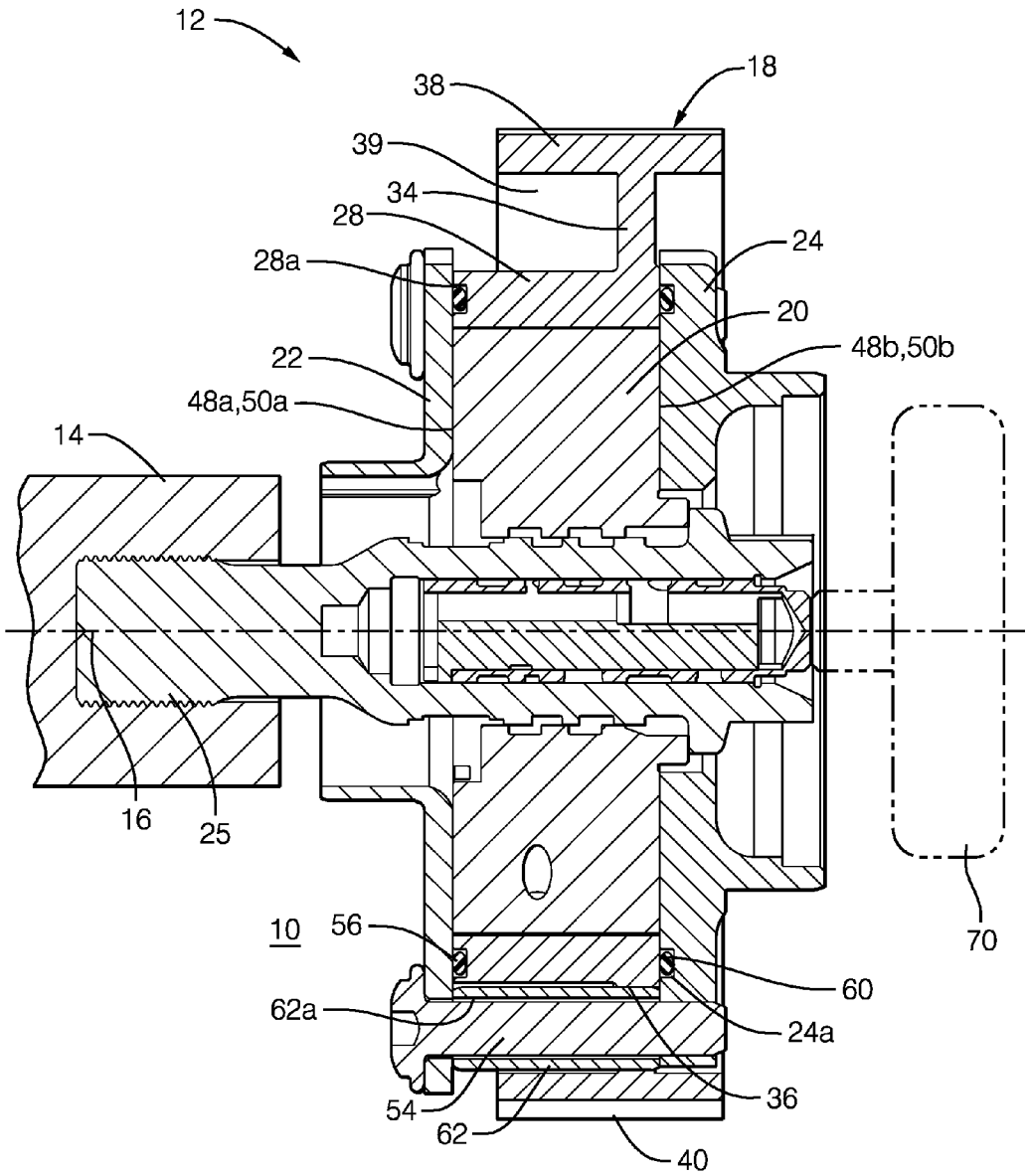
FIG. 3 is an axial cross-sectional view of the camshaft phaser of FIG. 1.

In accordance with a preferred embodiment of this invention and referring to FIGS. 1-3, an internal combustion engine 10 is shown which includes a camshaft phaser 12. Internal combustion engine 10 also includes a camshaft 14 which is rotatable about an axis 16 based on rotational input from a crankshaft (not shown) and a drive belt (not shown) driven by a plurality of reciprocating pistons (not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and/or exhaust valves can be advanced or retarded in order to achieve desired engine performance.

Camshaft phaser 12 generally includes a stator 18, a rotor 20 disposed coaxially within stator 18, a back cover 22 closing off one end of stator 18, a front cover 24 closing off the other end of stator 18, a camshaft phaser attachment bolt 25 for attaching camshaft phaser 12 to camshaft 14, and a valve spool 26 which directs oil to control the rotational position of stator 18 relative to rotor 20. The various elements of camshaft phaser 12 will be described in greater detail in the paragraphs that follow.

Stator 18 is generally cylindrical and includes an inner stator wall 28 which is annular in shape and centered about axis 16. A plurality of lobes 30 extend radially inward from inner stator wall 28, thereby defining a plurality of radial chambers 32. In the embodiment shown, there are three lobes 30 defining three radial chambers 32, however, it is to be understood that a different number of lobes 30 may be provided to define radial chambers 32 equal in quantity to the number of lobes 30. The back axial face of inner stator wall 28 may include a stator back O-ring groove 28*a* which is annular in shape. The purpose of stator back O-ring groove 28*a* will be described in greater detail late. Stator 18 also includes a stator flange 34 which extends radially outward from inner stator wall 28 such that stator flange 34 is centered about axis 16 and is annular in shape. Stator flange 34 includes a plurality of stator flange apertures 36 which extend therethrough in the same direction as axis 16. Stator flange apertures 36 are preferably circular and are preferably equally spaced around stator flange 34. While five stator flange apertures 36 have been illustrated (although not all labeled), it should be understood that a greater or lesser number of stator flange apertures 36 may be provided. It is important to note that inner stator wall 28 has a thickness in the axial direction, i.e. in the direction of axis 16, that is greater than stator flange 34 as can best be seen in FIG. 3. Stator 18 also includes an outer stator wall 38 which extends radially outward from stator flange 34 such that outer stator wall 38 radially surrounds stator flange 34. It is important to note that outer stator wall 38 has a thickness in the axial direction, i.e. in the direction of axis 16, that is greater than stator flange 34 as can best be seen in FIG. 3. Consequently, an annular recess 39 is defined radially between inner stator wall 28 and outer stator wall 38. The outer circumference of outer stator wall 38 includes a plurality of pulley teeth 40 which extend radially outward from therefrom. In this way, stator 18, via pulley teeth 40, is configured to engage complementary teeth of the drive belt (not shown) which transmits rotational motion from the crankshaft of internal combustion engine 10 to stator 18. As shown, outer stator wall 38 is offset axially in the direction toward front cover 24 compared to inner stator wall 28. However, outer stator wall 38 may alternatively be aligned with inner stator wall 28 or offset axially in the direction toward back cover 22 compared to inner stator wall 28 as may be required for pulley teeth 40 to mate appropriately with the drive belt.

Rotor 20 includes a central hub 42 with a plurality of vanes 44 extending radially outward therefrom and a central through bore 46 extending axially therethrough. The number of vanes 44 is equal to the number of radial chambers 32 provided in stator 18. Rotor 20 is coaxially disposed within stator 18 such that each vane 44 divides each radial chamber 32 into advance chambers 48 and retard chambers 50 such that advance chambers 48 extend axially from a back end 48*a* to a front end 48*b* and such that retard chambers 50 extend from a back end 50*a* to a front end 50*b*. The radial tips of lobes 30 are mateable with central hub 42 in order to separate radial chambers 32 from each other. Each of the radial tips of vanes 44 may include one of a plurality of wiper seals 52 to substantially seal adjacent advance chambers 48 and retard chambers 50 from each other. While not shown, each of the radial tips of lobes 30 may similarly include a wiper seal 52.

Back cover 22 is sealingly secured, using fasteners illustrated as cover bolts 54, to the axial end of stator 18 that is proximal to camshaft 14. Tightening of cover bolts 54 prevents relative rotation between back cover 22 and stator 18. Furthermore, a back O-ring 56 is located within stator back O-ring groove 28*a* and is compressed between stator 18 and back cover 22 in order to aid in sealing the interface between stator 18 and back cover 22. Back cover 22 includes a back cover central bore 58 extending coaxially therethrough. The end of camshaft 14 is received coaxially within back cover central bore 58 such that camshaft 14 is allowed to rotate relative to back cover 22.

Similarly, front cover 24 is sealingly secured, using cover bolts 54, to the axial end of stator 18 that is opposite back cover 22. Cover bolts 54 pass through stator 18 and threadably engage front cover 24, thereby clamping stator 18 between back cover 22 and front cover 24 to prevent relative rotation between stator 18, back cover 22, and front cover 24. In this way, advance chambers 48 and retard chambers 50 are defined axially between back cover 22 and front cover 24. Furthermore, front cover 24 includes a front cover O-ring groove 24*a* in the face of front cover 24 which faces toward stator 18 such that front cover O-ring groove 24*a* is annular in shape. A front O-ring 60 is located within front cover O-ring groove 24*a* such that front O-ring 60 is compressed between stator 18 and front cover 24 in order to aid in sealing the interface between stator 18 and back cover 22.

In order to prevent distortion of either or both of back cover 22 and front cover 24, due to the clamping load applied by cover bolts 54, which could compromise the seal between back cover 22 and stator 18 and between front cover 24 and stator 18, compression limiters 62 are provided. More specifically, compression limiters 62 extend from back cover 22 to front cover 24 by passing through stator flange apertures 36. It should be noted that compression limiters 62 are partially located within annular recess 39 radially between inner stator wall 28 and outer stator wall 38. Consequently, when cover bolts 54 are tightened, a clamp load is applied through compression limiters 62. As shown, compression limiters 62 are preferably tubes which each define a compression limiter passage 62*a* extending therethrough such that a respective cover bolt 54 passes through compression limiter passage 62*a*. Compression limiters 62 are most preferably cylindrical tubes. Compression limiters 62 are preferably sized to interface with stator flange apertures 36 such that compression limiters 62 are prevented from moving relative to stator 18 in a direction across axis 16, i.e. in a direction across a plane that is perpendicular to axis 16. Consequently, compression limiters 62 may interface with stator flange apertures 36 in a slip fit relationship or in an interference fit relationship.

Camshaft phaser 12 is attached to camshaft 14 with camshaft phaser attachment bolt 25 which extends coaxially through central through bore 46 of rotor 20 and threadably engages camshaft 14, thereby clamping rotor 20 securely to camshaft 14. In this way, relative rotation between stator 18 and rotor 20 results in a change in phase or timing between the crankshaft of internal combustion engine 10 and camshaft 14.

Oil is selectively supplied to advance chambers 48 and vented from retard chambers 50 in order to cause relative rotation between stator 18 and rotor 20 which results in advancing the timing of camshaft 14 relative to the crankshaft of internal combustion engine 10. Conversely, oil is selectively supplied to retard chambers 50 and vented from advance chambers 48 in order to cause relative rotation between stator 18 and rotor 20 which results in retarding the timing of camshaft 14 relative to the crankshaft of internal combustion engine 10. Advance oil passages 64 may be provided in rotor 20 for supplying and venting oil from advance chambers 48 while retard oil passages 66 may be provided in rotor 20 for supplying and venting oil from retard chambers 50. Supplying and venting of oil to and from advance chambers 48 and retard chambers 50 may be controlled by a multi-way oil control valve, illustrated herein as valve spool 26 together with camshaft phaser attachment bolt 25. Valve spool 26 is disposed within a valve bore 68 of camshaft phaser attachment bolt 25 such that valve spool 26 is displaced along axis 16 by an actuator 70 and a valve spring 72. Movement of valve spool 26 opens and closes passages between an oil supply (not shown) which is typically the lubrication system for internal combustion engine 10, a drain (not shown), advance oil passages 64, and retard oil passages 66 in appropriate combinations to either advance rotor 20 relative to stator 18, retard rotor 20 relative to stator 18, or hold the position of rotor 20 relative to stator 18. More specifically, valve spool 26 can be positioned to 1) supply oil to advance chambers 48 while simultaneously draining oil from retard chambers 50 in order to advance rotor 20 relative to stator 18, 2) supply oil to retard chambers 50 while simultaneously draining oil from advance chambers 48 in order to retard rotor 20 relative to stator 18, or 3) maintain the volume of oil in advance chambers 48 and retard chambers 50 in order to hold the position of rotor 20 relative to stator 18. Various arrangements are well known in the art for supplying and venting oil in camshaft phasers, and consequently further details will not be discussed herein. However, further details are provided in United States Patent Application Publication No. US 2012/0255509 A1 to Lichti et al. which is incorporated herein by reference in its entirety. Alternatively, the multi-way oil control valve may be located external to camshaft phaser 12 as is known in the art, for example as shown in United States Patent Application Publication No. US 2010/0288215 A1 to Takemura et al. which is incorporated herein by reference in its entirety. In this way, rotor 20 rotates within stator 18 between a maximum advance position and a maximum retard position as determined by the space available for vanes 44 to move within radial chambers 32.

By utilizing compression limiters 62 which pass through stator flange apertures 36, stator 18 can be designed to place cover bolts 54 in appropriate quantity and locations in order to achieve an adequate clamp load on back cover 22 and front cover 24 to maintain sealing between back cover 22 and stator 18 and between front cover 24 and stator 18. Utilizing compression limiters 62 which pass through stator flange apertures 36 also allows stator 18 to be made lighter in weight compared to stators that utilize radially extending ribs between the inner stator wall and the outer stator wall. In fact, the Inventors have realized a 25% reduction in weight of stator 18 with compression limiters 62 compared to a design which utilizes radially extending ribs between the inner stator wall and the outer stator wall. Furthermore, stator 18 with stator flange apertures 36 is more favorable to manufacturing stator 18 using powder medal process and stator 18 can also accommodate error proofing, i.e. Poka Yoke, features which could not be accommodated at all, or could not be accommodated without adding significant weight, in stator designs having radially extending ribs between the inner stator wall and the outer stator wall.

It should be noted that camshaft phaser 12 has been described herein in simplified form, and may include additional features that are known in the camshaft phaser art, such as, by way of non-limiting example only, a bias spring which biases rotor 20 to a predetermined position relative to stator 18 and one or more lock pins which mechanically lock rotor 20 in a predetermined position relative to stator 18. Further features that may be used in camshaft phaser 12 are described in U.S. Pat. No. 8,056,519 to Cuatt et al. which is hereby incorporated herein by reference in its entirety.

While this invention has been described in terms of preferred embodiments thereof, it is not intended to be so limited.

We claim:

1. A camshaft phaser for use with an internal combustion engine for controllably varying the phase relationship between a crankshaft and a camshaft in said internal combustion engine, said camshaft phaser comprising:

a stator extending along an axis and having an inner stator wall, said inner stator wall including a plurality of lobes extending radially inward therefrom and a stator flange extending radially outward therefrom, said stator flange having a plurality of stator flange apertures extending therethrough, said stator flange also having a first face and a second face which is opposed to said first face;

a rotor coaxially disposed within said stator, said rotor having a plurality of vanes interspersed with said plurality of lobes defining a plurality of alternating advance chambers and retard chambers extending axially from a back end to a front end;

a plurality of compression limiters, each one of said plurality of compression limiters extending through a respective one of said plurality of stator flange apertures such that one end of each one of said plurality of compression limiters is located on a same side of said stator flange as said first face and such that said one end of each one of said plurality of compression limiters extends axially beyond said first face;

a front cover which closes said front end of said plurality of advance chambers and said plurality of retard chambers;

a back cover which closes said back end of said plurality of advance chambers and said plurality of retard chambers; and a plurality of fasteners, each one of said plurality of fasteners extending through a respective one of said plurality of stator flange apertures such that said plurality of fasteners apply a clamping load which clamps said stator between said front cover and said back cover such that said clamping load is transmitted through said plurality of compression limiters.

2. A camshaft phaser as in claim 1 wherein said plurality of compression limiters are each a tube.

3. A camshaft phaser as in claim 2 wherein each one of said plurality of fasteners extends through a respective one of said plurality of compression limiters.

4. A camshaft phaser as in claim 2 wherein each of said plurality of compression limiters and each of said plurality of stator flange apertures are sized to prevent movement of said plurality of compression limiters within said plurality of stator flange apertures in a direction across a plane that is perpendicular to said axis.

5. A camshaft phaser as in claim 1 wherein said stator also includes an outer stator wall which extends radially outward from said stator flange and which radially surrounds said stator flange.

6. A camshaft phaser as in claim 5 wherein said outer stator wall defines an array of pulley teeth which extend radially outward therefrom.

7. A camshaft phaser as in claim 5 wherein said plurality of compression limiters are each a tube.

8. A camshaft phaser as in claim 7 wherein each one of said plurality of fasteners extends through a respective one of said plurality of compression limiters.

9. A camshaft phaser as in claim 7 wherein an annular recess is formed radially between said inner stator wall and said outer stator wall such that said plurality of compression limiters are located partially within said annular recess.

10. A camshaft phaser as in claim 5 wherein an annular recess is formed radially between said inner stator wall and said outer stator wall such that said plurality of compression limiters are located partially within said annular recess.

11. A camshaft phaser as in claim 5 wherein each of said plurality of compression limiters extends from said back cover to said front cover.

12. A camshaft phaser as in claim 11 wherein each of said plurality of compression limiters extends from said back cover to said front cover.

* * * * *